United States Patent [19]

Brede et al.

[11] 4,294,648

[45] Oct. 13, 1981

[54] METHOD FOR INCREASING THE RESISTANCE OF IGNITER ELEMENTS OF GIVEN GEOMETRY

[75] Inventors: Uwe Brede, Fürth; Heinz Kern, Fürth-Burgfarnbach, both of Fed. Rep. of Germany

[73] Assignee: Dynamit Nobel Aktiengesellschaft, Postfach, Fed. Rep. of Germany

[21] Appl. No.: 124,894

[22] Filed: Feb. 26, 1980

[30] Foreign Application Priority Data

Mar. 3, 1979 [DE] Fed. Rep. of Germany ..... 2908361

[51] Int. Cl.[3] ..... C23F 1/02

[52] U.S. Cl. ..... 156/627; 156/638; 156/656; 338/308

[58] Field of Search ..... 156/626, 627, 636, 638, 156/656, 664; 102/200, 206; 29/593, 610 R, 620; 338/308

[56] References Cited

U.S. PATENT DOCUMENTS 3,860,465 1/1975 Matzner et al. ..... 156/649

4,188,258 2/1980 Mounteer et al. ..... 156/657 X

*Primary Examiner*—William A. Powell

*Attorney, Agent, or Firm*—Sprung, Felfe, Horn, Lynch & Kramer

[57] ABSTRACT

A method for increasing the resistance of an igniter element of given geometry in an electrical circuit to a predetermined, specific value by the removal of resistance material, which comprises heating the resistance material situated between two acid-resistance electrodes simultaneously etching the resistance material with acid until the desired resistance value has been established.

7 Claims, 3 Drawing Figures

METHOD FOR INCREASING THE RESISTANCE OF IGNITER ELEMENTS OF GIVEN GEOMETRY

BACKGROUND OF THE INVENTION

1. Field of the Invention

The subject matter of the present invention is a method for increasing the resistance of igniter elements. Such alteration of resistance will be referred to hereinafter also as "trimming". Such resistance alteration is necessary especially when the igniter element is to ignite an initiating charge at a specified electrical voltage or current.

2. Discussion of Prior Art

Metal film resistances are known whose resistance is adjusted to a specified value by mechanical or optical balancing methods, wherein the conducting cross sections are adjusted to the desired value by altering the surface geometry. Such methods, however, are not suitable for the production of metal film igniting resistances, because in the igniter elements a very specific resistance must be related to a specific surface area. It is necessary, therefore, to vary the thickness of the resistance all across its area.

A known method for the practice of this alteration of the thickness of metal film igniter elements consists in an electrochemical ablation of the metal film, in which the metal film areas which are not to be removed are masked with a resist coating and thus shielded from attack by the electrical current.

This electrolytic trimming method has the disadvantage that the resist coating often is not in sufficiently intimate contact with the conducting metal and consequently unintended etching takes place on the resistances, or undercutting can take place a points where paths of conduction reach the metal films. Also, this method is not suitable for the production of metal layer igniter elements of very small size.

The problem therefore existed of developing a trimming method for metal film igniter elements which is suitable for igniter elements of very small size, and in which there is no danger that the conductor can also be attacked.

SUMMARY OF THE INVENTION

As a solution to this problem, a method has now been found for increasing the resistance of igniter elements of given geometry within a circuit to a predetermined, specific value by the ablation of resistance material, which is characterized by heating the resistance material situated between two acid-resistant electrodes and simultaneously etching it with acid until the desired resistance value has been established.

This method is particularly well suited for the trimming of metal layer igniter resistances of very small dimensions, having, for example, a length of 30 to 200 μm, a width between 20 and 200 μm and a thickness between 0.1 and 1.5 μm, although it can also be used in the case of igniter resistances of larger dimensions.

The igniter resistances can be of any desired material which is attacked by acids and which conducts electrical current. Examples of suitable materials are chromium, nickel or nickelic alloys, tantalum, or tantalum nitride. The last two materials are especially suited for the method of the invention. The materials which can be treated in accordance with the invention are: palladium, silver, palladium-silver alloys, silicon.

According to the invention, the igniter resistances are heated and at the same time attacked by acids. The heating is performed preferably electrically, but any other heat source which insofar as possible focuses the heat at the igniter resistance alone, can be employed. The temperature level depends on the resistance material and on the acid that is used. Broadly speaking, the resistance material is heated to a temperature of 20° to 150° C., preferably 80° to 110° C.

In general it can be said that the higher the temperature is, the more rapidly the attack of the acid takes place. The temperature to be selected depends furthermore on the electrode material whereby the igniter resistances are connected to the rest of the electrical circuit. If these contacts consist, for example, of noble metals of Group VIII of the periodic table of the elements, the temperature of the resistance element can amount ot 100° C. when hydrochloric or nitric acid is used. Temperatures of this order of magnitude can also be applied in the case of alloys of these metals with silver, gold or silver-palladium alloys. However, the effect of the invention also takes place at lower temperatures depending on the material of which the igniter resistance consists and on the acid that is used. As soon as the igniter resistance has reached the desired ohmic resistance, the heating is stopped—by interrupting the electrical circuit in the case of electrical heatings. The process is particularly useful in adjusting the resistances of igniter materials to resistances in the range of 0.1 to 20 ohms.

Suitable acids are fundamentally both inorganic and organic liquid acids which attack the resistance material. It is preferred to use those acids which evaporate rapidly at the temperatures selected, so that, after the desired resistance value is reached and the heat source has shut off, the remainder of the acid on the resistance material will quickly evaporate and no longer produce any etching effect. Particularly suitable, therefore, are the nitrogen-oxygen acids, such as nitric acid $HNO_3$ and aqueous solutions of hydrohalic acids such as hydrochloric acid. When aqueous solutions of the acids are used, the concentration of the solutions will be governed by the strength of the acid, the degree of dissociation, and the etchability of the resistance material for the selected acid. The concentration must be selected such that the resistance material will be etched at the temperature which is to be employed. Generally, the acid strength is 10 to 80 percent, preferably 50 to 70 percent.

Materials of good absorbency, such as sponges, fabrics or felts are especially suitable for the removal of the material released from the resistance material by the action of the acid. These materials are to be highly resistant to acids; it is especially advantageous to imbibe these absorbent substances with the acid and to move the imbibed material on the igniter material with a gliding or rubbing action. This movement can be circular or reciprocating, depending on the shape of the igniter material.

It is furthermore advantageous for this absorbent material to be fastened to a holder of any desired shape; the holder can be in the form, for example, of a shaft having a round, oval or polygonal cross section. This embodiment has the advantage that, after the desired resistance of the igniter element has been reached, the holder can be lifted away from the igniter element either by hand or by means of appropriate devices, so that, immediately, there will be no longer any acid on the igniter element.

The igniter element is disposed in an electrical circuit so that its resistance can be continuously measured. The measurement is performed in a known manner.

BRIEF DESCRIPTION OF DRAWINGS

Referring to appended drawings.

DESCRIPTION OF SPECIFIC EMBODIMENT

Figure 1:
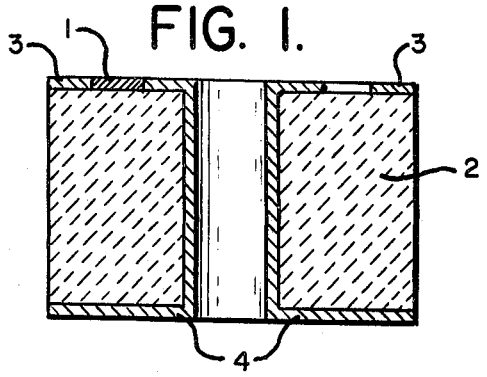
FIG. 1 is a cross-sectional view of an igniter element of the type used for the ignition of initial detonating agents based on, for example, lead azide or lead trinitroresorcinate, the view being taken along line I—I of FIG. 2.
Figure 2:
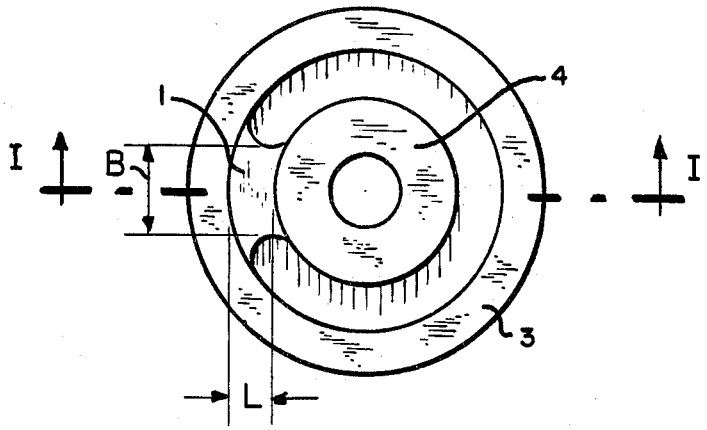
FIG. 2 is a top plan view of an igniter whose cross sectional view is shown in FIG. 1.

Referring to FIGS. 1 and 2, the igniter resistance 1 is situated on a ceramic support 2 and is connected by the electrodes 3 and 4 to an electrical circuit (which is not shown). The igniter resistance has a given width B and at a length L. It is applied to the support by means of appropriate, known coating methods, and has a lower ohmic resistance than that which the finished element will be given by the procedure of the invention.

Figure 3:
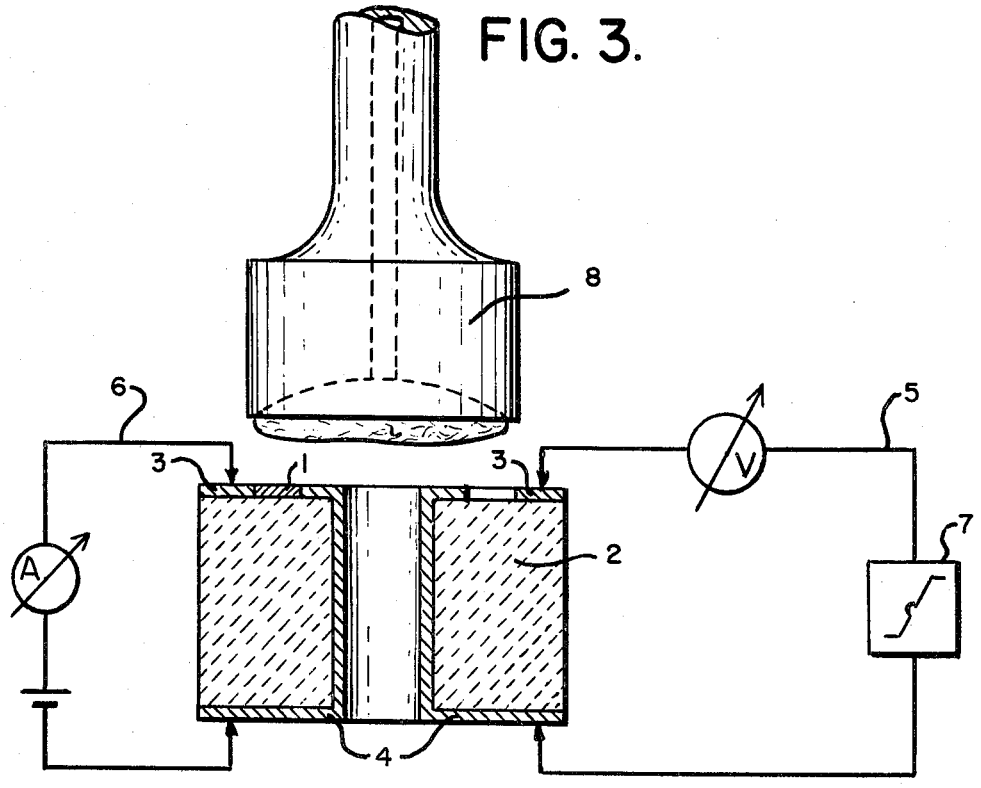
FIG. 3 is a circuit diagram for the practice of the invention wherein the ignition resistance 1 is heated electrically.

FIG. 3 the circuit diagram, shows the electrodes 3 and 4, which here are to be made of gold. They serve to connect the resistance 1, consisting for example of tantalum nitride with a nickel overlay, on the one hand to a measuring voltage circuit 5 and on the other hand to a heating and measuring current circuit 6. A threshold-value switch 7 is placed in the measuring voltage circuit 5. Above the resistance there is disposed a pad holder 8 provided on its bottom end with a pad of felt, fabric, sponge or the like, this absorbent material being situated, for example, in a dish-like recess in the pad holder 8, and projecting to some extent from the face of the plunger opposite the igniter resistance 1. The absorbent material is imbibed with dilute nitric acid, for example. The acid is fed downwardly to the absorbent material preferably through a bore in the axial center of the pad holder 8, at the rate required in the individual case. When the felt pad holder is lowered onto the surface of the metal element, the resistance surface, heated to approximately 100° C. by the heating current, is attacked by the acid. The eroded material is absorbed by the felt; at the same time the ohmic resistance of the igniter element 1 is altered. After a predetermined and established threshold voltage is reached, to which a resistance value corresponds according to Ohm's law, the threshold value switch 7 cuts off the current from the heating and measuring current circuit 6. At the same time the felt pad holder is automatically lifted from the surface of the igniter resistance 1, which thus has the desired resistance value.

What is claimed is:

1. A method for increasing the resistance of an igniter element of given geometry in an electrical circuit to a predetermined, specific value by the removal of resistance material, which comprises heating the resistance material situated between two acid-resistance electrodes simultaneously etching the resistance material with acid until the desired resistance value has been established.

2. A method according to claim 1, wherein the resistance material is heated electrically and the current flow is shut off after the desired resistance value is reached.

3. A method according to claim 1, wherein the resistance value of the resistance material is measured continuously during the acid treatment.

4. A method according to claim 1, wherein the acid treatment is performed with the aid of an absorbent material carrying the acid and the resistance material so ablated is absorbed by the absorbent material.

5. A method according to claim 4, wherein the absorbent material carrying the acid is moved in a gliding or rubbing movement on the resistance material by means of a plunger, until, after the desired resistance value is reached, it is lifted away from the resistance material.

6. A method according to claim 4, wherein felt is used as absorbent material.

7. A method according to claim 1, wherein dilute nitric acid is used as the acid.

* * * * *